United States Patent [19]

Chen

[11] Patent Number: 4,664,224

[45] Date of Patent: May 12, 1987

[54] LIFE-ESCAPING STEEL CABLE LADDER FOR HIGH-BUILDING USE

[76] Inventor: Ying-Hung Chen, No. 90, Yu Ai Road, Chiayi City, Taiwan

[21] Appl. No.: 913,574

[22] Filed: Sep. 29, 1986

[51] Int. Cl.[4] ..... E06C 1/56

[52] U.S. Cl. ..... 182/73; 182/106; 182/196

[58] Field of Search ..... 182/74, 73, 70, 196, 182/197, 198, 106

[56] References Cited

U.S. PATENT DOCUMENTS

| | | | |
|---|---|---|---|
| 267,019 | 11/1882 | Palmer | 182/74 |
| 293,215 | 2/1884 | Coe | 182/74 |
| 595,082 | 12/1897 | Smoot | 182/73 |
| 920,956 | 5/1909 | Jeffries | 182/73 |
| 993,368 | 5/1911 | Hartmann | 182/74 |
| 1,395,563 | 11/1921 | Drozdzynski | 182/73 |
| 2,629,531 | 2/1953 | Hakkarinen | 182/73 |
| 3,900,081 | 8/1975 | Dunston | 182/73 |

FOREIGN PATENT DOCUMENTS

| | | | |
|---|---|---|---|
| 2309246 | 3/1975 | France | 182/73 |

*Primary Examiner*—Reinaldo P. Machado

*Attorney, Agent, or Firm*—Browdy and Neimark

[57] ABSTRACT

The present disclosure is directed to a retractable and flexible steel cable ladder device adopted for descending people from a high building in fire accident, which can be emergently mounted on the wall of a window or place of the like, so that the flexible steel cable ladder thereof can be lowered down quickly for people to step down therefrom. The device consists of a symmetrically constructed frame having a rotatable shaft disposed thereon, on which the flexible steel cable ladder is receivably winded, and a stepping on board is disposed thereon with the shaft covered thereunder, and a pair of arcuatedly shaped grip handles are removably planted on the top thereof, a number of fixing screws are attached to the rear vertical poles of the frame and a pair of support frame members are also disposed on each side thereof which abut against the wall so that the device can be firmly and securely planted thereto, and the steel cable ladder can be released or retrieved by means of a worm rod having an operating handle at one end and engaging with a worm gear which fixed at one end of the shaft of the ladder winding means so to effect the releasing and retracting operation of the steel cable ladder.

5 Claims, 8 Drawing Figures

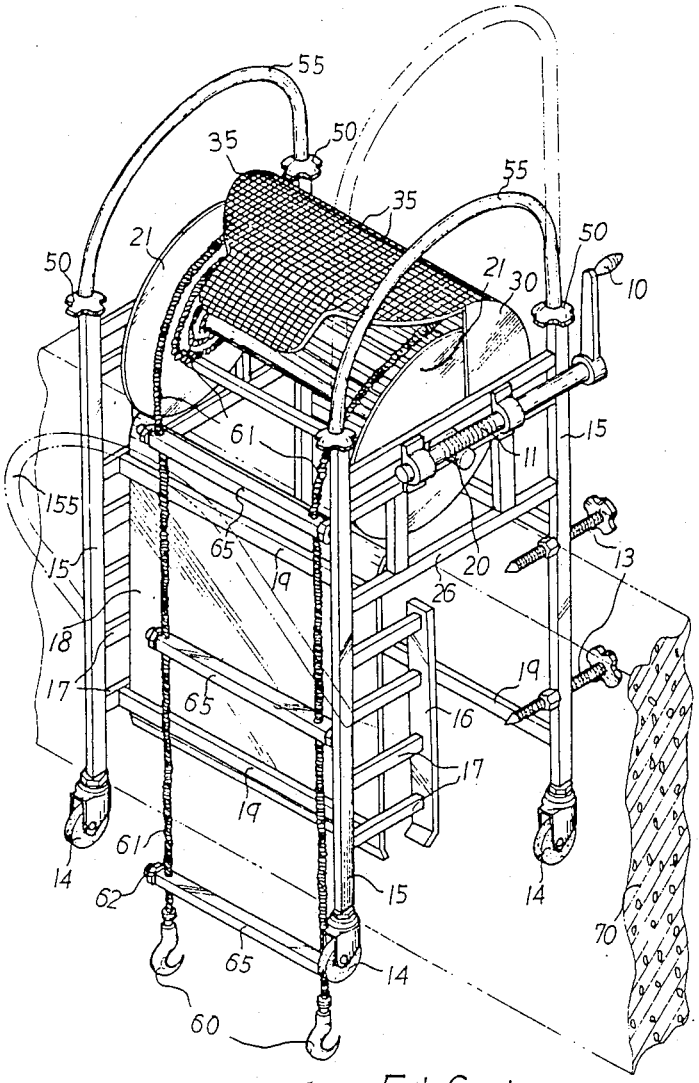
FIG. 1
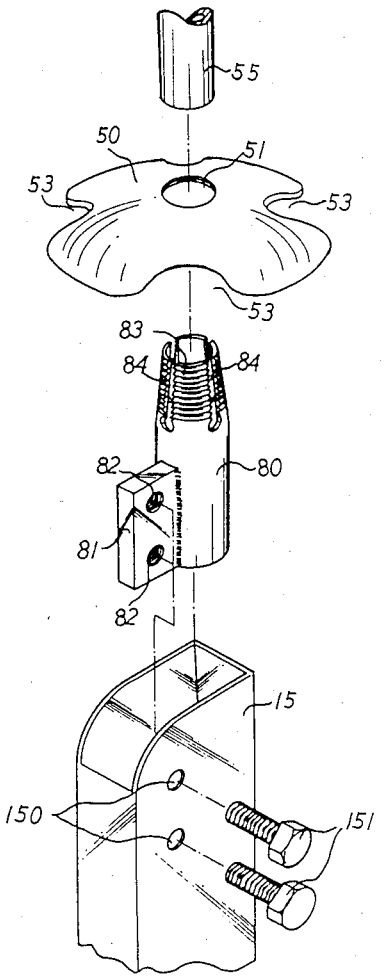
FIG. 2
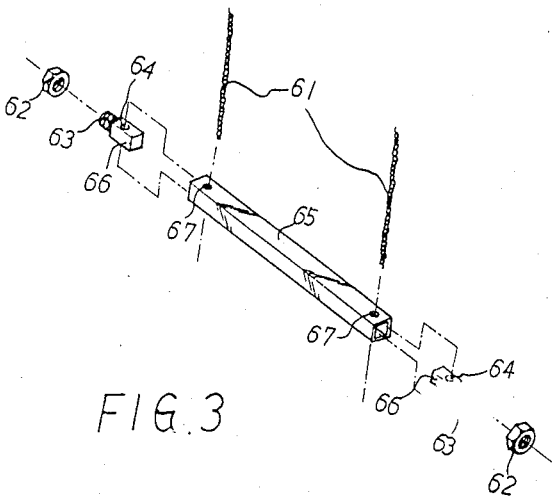
FIG. 3
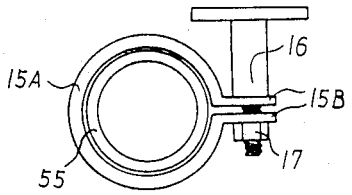
FIG. 2-A

LIFE-ESCAPING STEEL CABLE LADDER FOR HIGH-BUILDING USE

SUMMARY OF THE INVENTION

The present invention relates to a life-escaping steel cable ladder for high fuilding use in general, and more particularly to a flexible ladder device consisting of a symmetricaly-constructed rectangular frame having a ladder-winding shaft means mounted thereon which is equipped with a worm gear at one end thereof so that said shaft means can be rotatably operated when a worm rod, having a turning handle at one end and engaging with said worm gear, is actuated to rotate, and said steel cable ladder can be released or retracted thereby, a piece of vertical support plate is fixedly attached to the frame, and a number of pointing fixing screws are placed at the rear side of said frame for fixing the device to a wall, four wheel members are mounted on four legs of said frame for facilitating to move the device, a step-on board of steel plate, having a roughened surface for preventing slippery accident from happening, is set at the top of the frame with a pair of U-shaped grip handles removably mounted on the legs of said frame by means of several cylindrical elements having a tapered end which is provided with a number of splits and externally threaded surface so that the inserted legs of said grip handles can be held tightly at position when pieces of flora-shaped cap members are adopted to tighten the tapered ends of said cylindrical elements.

The escaping device can be readily moved to a mounting place with the help of said four wheel members and be fixedly attached to the wall of a window or the like place by means of said fixing screws thereof, then said reverse U-shaped handles are fixedly mounted thereon, and the flexible steel cable ladder is extendedly lowered down by operation of the worm rod in one direction and the released ladder is fixedly grounded by means of a pair of hooks disposed at the bottom ends thereof, so that people trapped in fire accident can escape via the ladder from a high building.

Fires have been the most fatal and life threatening dangers to those people living in high-rised buildings in modern cities, it naturally becomes the primary concern for those people to have a readily available life-escaping means at their hands. Most of the available instrument used against fire accidents are related to fire a1arm or fire extinguishing equipments, not many life-escaping devices are found available on the market.

The primary object of the present invention is to provide a retractable steel cable ladder for high building life escaping purpose which consists of a rectangular construction frame with a rotatable shaft means mounted thereon for windingly receiving the steel cable ladder which then can be extendedly released when needed, and the whole device is able to be readily mounted on the wall of a window or place of the like in emergency so that people can escape from a fire accident through the steel cable ladder.

One further object of the present invention is to provide a retractable steel cable ladder for high building life escaping purpose, which is equipped with an arcuated step-on board, disposed on the top of the device, which has a roughened surface with square grids, and a pair of arcuated grip handles are detachably mounted on the top of the frame in view of saving space.

For better demonstrating the structure, features, and operational modes of the present invention, figures are provided in accompany with detailed description.

BRIEF DESCRIPTION OF THE DRAWINGS

FIG. 1 is a perspective view of the life-escaping device of the present invention.

FIG. 2 is a diagram showing the handle-receiving cylindrical element having tapered and symmetrically splited end and its associated fastening parts.

FIG. 2A is a diagram showing another approach of removably fixing the grip handle to the frame.

FIG. 3 is a diagram showing the exploded components of the step rod and its fastening parts.

DETAILED DESCRIPTION OF THE INVENTION

Figure 4:
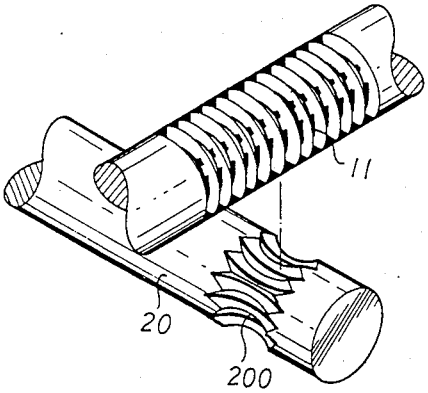
FIG. 4 is a diagram showing the worm rod as well as the corresponding worm gear disposed at the end of shaft.

Referring to FIG. 1, the present invention is constituted of a number of vertical poles 15 and lateral bars 26 and step rods 19 to form a symmetric frame structure, and a shaft 20 for windingly receiving the steel cable ladder thereon is rotatably mounted by way of a pair of bearings located between the topmost lateral bars 26 with pair of disk member 21 disposed on the two respective ends thereof, and a worm gear 200 is protruded from the end of said shaft 20 as shown in FIG. 4 for engaging with a worm rod 11 which is rotarily operated by a handle 10 so to spin said shaft 20 either to extendedly release said steel cable ladder or to retract the extended ladder for receiving the same thereon; the flexible steel cable ladder is formed of two elongate parallel steel cable 61 and a plurlaity of step bars 65 having square cross section, and is fixedly attached to said disk member 21 with its respective end so that said cable ladder can be windingly received thereon. A piece of arcuated steel plate 30, having a roughened surface with a plurality of square grids 35 thereon, is disposed in such a manner that it can partially cover said disk member 21 as well as said shaft 20 and provide a step-on place for users; and under said disk member and shaft, there is disposed a vertical plate 18 extending its length almost to the bottom of said vertical pole 15; a pair of support frames 16 joined by means of a number of connecting bars 17 respectively to the inner side of said vertical poles 15 is used in combination with a number of symmetrically disposed fixing screws 13 on the rear vertical poles 15 for mounting purpose, four wheel members 14 are attached to the bottoms of said vertical poles 15 for easily moving said device to a mounting place; a pair of hooks 60 are also attached to the bottom ends of said steel cables respectively for fixing purpose, a pair of reverse U-shaped grasp handles 55 are detachably mounted on said vertical poles 15, and a protection frame 155 is also obliquely attached thereto for protection use.

Continuing to refer to FIG. 2, there are two screw holes 150 set on the top end of respective vertical poles 15 for installation of a sleeve element 80 therein, which has a rectangular projection 81 with two corresponding screw holes 82 disposed thereon so that bolts 151 can fix said sleeve element 80 to said vertical pole 15; the top end of said sleeve element is defined in a tapered shape with a number of splits 84 and a threaded periphery 83 so that a cap member 50 having a central hole 51 which is innerly peripherally threaded, with a number of peripherally disposed arcuate recess 53, is able to engage with said sleeve element 80 by way of the threads 83 so to removably lock the inserted leg of said reverse U-shaped grip handle 55 in place which passes through said central hole 51 of said cap member 50 and planted inside said sleeve element 80. As shown in FIG. 2-A, the grip handle 55 can alternatively be fixed tightly in place by a bolt 16 and nut 17 in combination with a clamp element 15A in which the leg of said grip handle is inserted.

As shown in FIG. 3, between two parallel steel cables 61, there are attached a plurality of step rods 65 of square cross section, equally distanced, which have two separate holes 67 at each end thereof for allowing said steel calbes to go therethrough when assembled. Said step rods 65 are fixed in place by menas of bolts 63 having elongated portions 66 of square cross section and holes 64 for the same to go therethrough, and nuts 35 are used to tighten said step rods 65 and steel cables together in assembly.

It becomes clear now that, in emergency, the escaping ladder device of the present invention can be quickly moved by way of said wheel members 14 disposed thereunder to a mounting site, and astride placed on a wall 70, fixing screws 13 are then applied to effect the purpose of fixing the present device to said wall 70; the grip handle 55 then can be adjustably pulled out to a proper length after the cap member 50 is loosely disengaged, then fixed at that length by tightening the same again. The winded steel cable ladder on said shaft 20 can then be extendedly lowered down by actuation of said handle 10 to spin said worm rod 11 in one selected direction, and then said ladder is firmly grounded by means of the hooks at the bottom ends of said cables 61 for use.

Figure 5:
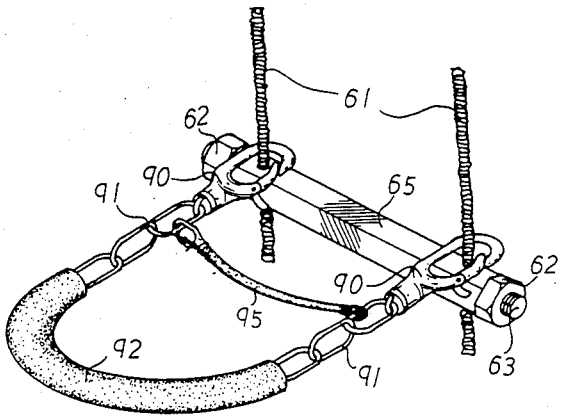
FIG. 5 is a diagram showing a security chain is detachably connected to the ladder.

Moreover, said handle 10 can be detached from said worm rod 11 and re-attached in a reverse manner, after steel cables 61 are grounded by means of said hooks, so that the shaft 20, on which the flexible ladder are winded, can be stopped to spin as a result of the protruded oval-shaped element being located against said vertical pole 15, and in consideration of safety, a person can also be lowered down slowly with the help of another person operating the handle 10 to slow down the spin of said shaft 20. As shown in FIG. 5, a chain 91 having hooks 90 disposed at both ends, and wrapped with plastic cover 92, is able to be attached to said steel cable 61 to protect a person from accidentally falling off the ladder when the same is slowly lowered down.

Figure 6:
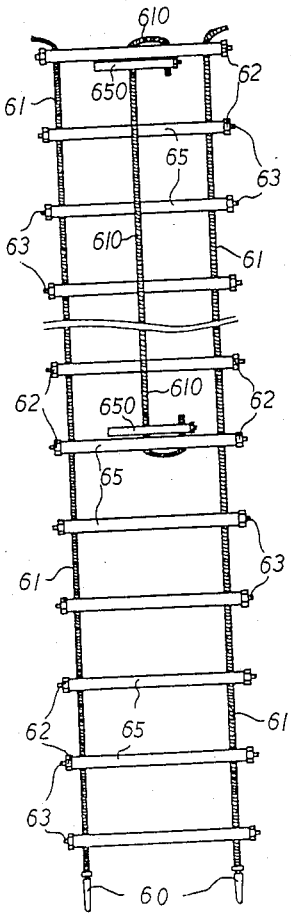
FIG. 6 is a diagram showing the flexible steel cable 1adder with an auxiliary cable fixedly extended across the middle thereof.
Figure 7:
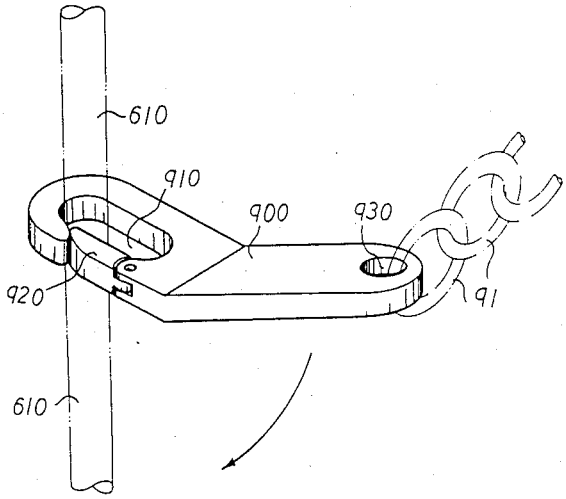
FIG. 7 is a diagram showing the structure of the hook element.

Furthermore, as shown in FIG. 6, an auxiliary steel cable 610 is attached to and extended across the middle of the flexible steel cable ladder, with the top and bottom thereof fixed by means of fixing bars 650 to the first step bar 65 from the top and the fifth or seventh step bar 65 from the bottom respectively, so that said auxiliary steel calbe 610 extends across a plurality of step bars 65 thereof and is used in combination with a hook element 900 as shown in FIG. 7 to enable a person to attach himself to said auxiliary steel cable by means of a chain 91 which is coupled to said hook element 900 via an attaching hole 930 at one end thereof, and the other end of said hook element having a push-open member 920 is associated with said auxiliary steel cable with the same disposed through a fixing hole 920 for the purpose of increasing safety in using this ladder device. Said hook element 900 is adapted to be arcuately bended in L shape so that even in the accident in which a person slipped from the step bars 65 and dropped to ward the ground, the bottom side of said hook element 900 can continuously frictionally abut against said auxiliary cable owing to lever effect so to effectively slow down and stop the dropping act.

I claim:

1. A life-escaping steel cable ladder device for high-building use, comprising a frame which is made of a plurality of orthogonally-disposed vertical poles and horizontal tubular rods of square cross section and cnnstructed with a ladder-winding shaft rod disposed thereon, which is supported at both ends by a pair of symmetrically-disposed bearings attached on said frame, and a pair of disk members being fixedly attached to both ends thereof with a worm gear planted at the rightmost end which engages with a worm rod mounted on the side of said frame and actuated to rotate by a handle means so that the flexible ladder means consisting of two parallel steel cables and a plurality of step rods horizontally attached therebetween at equal distance, can be windingly received thereon, and a pair of hooks being fixedly attached to the respective end of said steel cables for fixing purpose, an arcuate steel board, having a plurality of grids planted on the surface, being attached on the top of the ladder winding means and serving as a step-on place, and a pair of reverse U-shaped grip handles being removable attached to the top of said frame with a number of wheel members placed thereunder for readily moving the ladder device to a mounting location, a vertical plate located under said ladder winding means and extending therefrom to the bottom of said frame, a support frame consisting of a number of horizontal bars and a vertical support element, being attached to the front vertical poles of said frame respectively and mounted with said vertical support element facing the wall of said mounting place, and a number of fixing screws being attached to the rear vertical poles respectively for fixedly locking said frame in place after the same is astride disposed on the wall of said mounting place.

2. A life-escaping steel cable ladder device for high building use as claimed in claim 1, wherein a pair of holes are disposed at the top end of each said vertical pole for the purpose of mounting of a sleeve element which has a rectangular projection attached thereon with two corresponding holes for receiving a pair of bolts therein so that said sleeve element can be secured to said vertical pole, said sleeve element having a tapered and externally peripherally threaded top end with a number of elongate splits planted thereon in such a way the leg of said grip handle can be received in said sleeve element and adjustably mounted on said vertical pole, and a cap member having a central hole which is inner threaded to engage with said threaded surface of said sleeve element so to secure the inserted leg of said grip handle in place.

3. A life-escaping steel cable ladder device for high building use as claimed in claim 1 wherein a plurality of tubular hollow step rods, each having a hole at its end for the passing through of said steel cable, are fixedly arranged at equal distance between said parallel steel cables by means of a plurality of bolts, each having a rectangular head having a cable-through hole thereon, and nuts, so that said step rods are fixedly fastened to said steel cables.

4. A life-escaping steel cable ladder device for high-building use as claimed in claim 1 wherein an auxiliary steel cable is extended across the middle thereof with its top end fixedly attached to the first step bar from the top and the opposite end fixedly attached to either step bar of the fifth to the seventh numbered from the bottom of said ladder for security purpose.

5. A life-escaping steel cable ladder device for high-building use as claimed in claim 4 wherein said auxiliary steel cable can be used in combination with a chain which encircles the body of the user so to prevent him or her from falling off, and an arcuately upward bended hook element slightly resembling the letter L, having an attaching opening in elliptical form at the front end which is equipped with a one way push-open member so that the hook element can engage with said auxiliary steel cable readily in emergency, and in case of an accidental falling, the L-shaped hook element is adapted to abut against the surface of said auxiliary steel cable owing to a lever effect to stop the falling effectively.

* * * * *